United States Patent [19]

Simeth

[11] Patent Number: 4,603,631

[45] Date of Patent: Aug. 5, 1986

[54] PERFECTING PRINTING PROCESS AND APPARATUS FOR A SHEET-FED OFFSET PRESS

[75] Inventor: Claus Simeth, Offenbach am Main, Fed. Rep. of Germany

[73] Assignee: M.A.N.-Roland Druckmaschinen Aktiengesellschaft, Fed. Rep. of Germany

[21] Appl. No.: 696,450

[22] Filed: Jan. 30, 1985

[30] Foreign Application Priority Data

Jan. 30, 1984 [DE] Fed. Rep. of Germany ..... 3403065

[51] Int. Cl.[4] ..... B41F 3/40

[52] U.S. Cl. ..... 101/229; 101/141; 101/177; 101/DIG. 28; 101/450.1

[58] Field of Search ..... 101/136, 137, 141, 142, 101/145, 174, 177, 229, 426, 450.1, DIG. 28

[56] References Cited

U.S. PATENT DOCUMENTS

| | | | |
|---|---|---|---|
| 1,026,936 | 5/1912 | Sturtevant | 101/229 X |
| 1,075,575 | 10/1913 | Johnston | 101/229 |
| 2,170,025 | 8/1939 | Jordhoy | 101/352 |
| 3,196,788 | 7/1965 | Knowles | 101/229 |
| 3,452,672 | 7/1969 | Bozza-Schunemann et al. | 101/177 |
| 4,421,027 | 12/1983 | Fischer | 101/DIG. 28 X |

FOREIGN PATENT DOCUMENTS

| | | | |
|---|---|---|---|
| 504639 | 7/1954 | Canada | 101/229 |
| 280504 | 5/1952 | Switzerland | 101/174 |

*Primary Examiner*—Edgar S. Burr
*Assistant Examiner*—John A. Weresh
*Attorney, Agent, or Firm*—Leydig, Voit & Mayer, Ltd.

[57] ABSTRACT

A process and apparatus for perfecting printing on paper sheets, one side being printed by the offset method and the other side being printed by direct planography, is provided for a five-cylinder sheet-fed offset press having an impression cylinder, first and second plate cylinders and first and second blanket cylinders, the latter being disposed respectively between the plate cylinders and the impression cylinder, wherein one or more printing plates suitable for direct planography are clamped on the impression cylinder in accordance with the size relationship between the impression cylinder and the blanket cylinders, the first plate cylinder and first blanket cylinder are arranged so as not to transfer indicia although the blanket cylinder is engaged with the impression cylinder, the effective diameter (d) of the first blanket cylinder is made slightly less than the dimension that corresponds to an integral multiple (or reciprocal thereof) of the effective diameter (D) of the impression cylinder, and the pressure between the first blanket cylinder and the impression cylinder is adjusted to be greater than the pressure between the second blanket cylinder and the impression cylinder, the second plate cylinder and blanket cylinder being arranged for one side offset printing, and the offset printing process and the direct planography printing each being controlled in known manner.

14 Claims, 5 Drawing Figures

PERFECTING PRINTING PROCESS AND APPARATUS FOR A SHEET-FED OFFSET PRESS

FIELD OF THE INVENTION

The present invention relates generally to a process and associated apparatus for perfecting printing on paper sheets, one side being printed by the offset method and the other side being printed by direct planography.

BACKGROUND OF THE INVENTION

Perfecting printing can be carried out in a variety of ways. In the case of conventional presses the sheets must be restacked after the first side has been printed in order that the second side can be printed in a second pass. However, this complexity is unsatisfactory when perfecting printing is required frequently. Another possibility is to turn the sheets within the press so that first one side of the paper is printed and, thereafter, the sheet is turned and the second side of the paper can be printed in the next printing unit. However, the cost of such a turning facility is appreciable. Also, a relatively large number of printing units are required depending upon the number of colors required to be printed. Another difficulty of such printing is that after the sheet has been turned, it is conveyed onwards with its back edge at the front. Registration therefore becomes difficult and more particularly a second gripper edge is required for this purpose. Consequently, conveyance of the sheet depends upon a relatively large number of transfers and requires the paper to be cut accurately on all sides.

In the past, efforts have been made for single-step perfecting printing wherein the sheet is printed simultaneously from the top and from the bottom in a printing zone. There have been many variations on this theme. More particularly, the possibility of perfecting printing between two blanket cylinders has been carried into practical effect both in sheet-fed offset printing and in web offset printing. Presses comprising two consecutive complete offset printing units have been disclosed; unfortunately they require a sheet transfer between the first printing and second printing. For the sake of simplification, therefore, the offset impression cylinder has had one or more printing plates placed on it and by alternate changeover has been used as a plate cylinder and also as a backing cylinder for offset printing and as a plate cylinder for direct planography.

In the prior art, DE-PS No. 179 218 discloses a perfecting printing press having two hard printing formes and a backing element and transfer element respectively. The printing unit has a transfer cylinder or backing cylinder and two forme cylinders of the same size. An inking unit and a damping unit for planographic printing are associated with each forme cylinder. The transfer cylinder has a soft surface and is disposed between the two forme cylinders. The paper passes through between the transfer cylinder and the first forme cylinder with the transfer cylinder transferring the indicia of the second forme cylinder to the bottom of the paper—i.e., by indirect transfer as the first forme cylinder acts as backing cylinder for indirect printing. However, the other side of the paper is printed directly by the first forme cylinder with the transfer cylinder being operative from this point of view as a soft backing cylinder. In accordance with the prior printing process, the printing plate on the first forme cylinder must be copied in laterally inverted relationship to the printing plate on the second impression cylinder.

Another prior reference, DE-PS No. 366 371 discloses a rotary lithographic press having a small blanket cylinder and a second cylinder several times larger than the blanket cylinder with both cylinders having grippers. Depending upon the nature of operation and construction, two or three printing plates can be disposed on the second cylinder. Correspondingly, at least one inking device is associated with the second cylinder. If an appropriate arrangement is made, the inked first plate can be copied without paper feed on the blanket of the first cylinder. When the second plate comes into the printing zone, a sheet is supplied. As it passes through the printing zone the sheet is printed in offset by the small cylinder and in direct planography by the large cylinder, the two cylinders working as backing cylinders for the respective other printing process.

It is also recognized as desirable for presses of the kind described that a single cylinder of a press should not serve just one purpose. Correspondingly, printing plates are placed on the pressing cylinders or pressers and the blanket cylinders are used as pressers. It is also known to use a softly covered cylinder as a backing cylinder for direct planographic printing. The problem in these cases is that both the direct planographic printing and the indirect offset printing must proceed under the same conditions—i.e., the press setting selected for pressure and cylinder packings must be satisfactory for both forms of printing.

Printing zone requirements for optimum direct planographic printing are, of course quite different from those for offset printing. Many different factors are concerned here, but the chief point is the fact that in direct planographic printing the paper surface contacts a hard smooth plate surface—i.e., the paper surface must adapt to the surface of the planographic plate—whereas in offset printing the relatively soft blanket surface conforms to the paper surface. The paper surface must therefore be adapted to the plate surface. This can occur with a soft impression cylinder or with a blanket cylinder. This requires a relatively high pressure engagement or pressure setting between the cylinders. If, however, the blanket cylinder is also used to transfer indicia, as occurs in the cases described, there is bound to be interaction between the print conditions of the two processes. On the one hand, if the pressure is adjusted to be suitable for offset printing, the pressure for direct planographic printing will be too low—i.e., the printing may be unsatisfactory due to the paper not being pressed sufficiently tightly on to the planographic plate. Completeness and uniformity of indicia depend upon the smoothness of the paper. On the other hand, if the pressure adjustment is adapted for direct planographic printing—i.e., is higher than the pressure required for offset printing—the pressure for the offset printing is excessive and the ink will be squeezed apart between the blanket and the paper, with the result of an unwanted print widening. In other words, the quality of the print on both sides of the paper is impaired in opposite senses.

A middle ground must therefore be found such that there is very little adverse interaction between the two processes. Also, special unwinding conditions are operative for direct planographic printing since the paper must not be allowed to rub on the printing plate. This may occur if conditions are set up incorrectly in the printing zone where the blanket or backing cylinder makes flexing movements. If the flexing movements result in relative movements of the paper on the printing plate, the plate surface rapidly suffers from damage or even becomes unserviceable.

OBJECTS AND SUMMARY OF THE INVENTION

It is therefore the object of the invention to provide a process and the associated apparatus in accordance with the category of presses hereinbefore set out, such that perfecting printing is possible in a sheet-fed gripper system without adverse interaction between the specifically different adjustments needed for the two printing processes.

According to the invention, a process for perfecting printing on paper sheets, one side being printed by the offset method and the other side being printed by direct planography, is provided in a five-cylinder sheet-fed offset press having an impression cylinder, first and second plate cylinders and first and second blanket cylinders, the latter being disposed between the respective plate cylinders and the impression cylinder, wherein one or more printing plates suitable for direct planography are clamped on the impression cylinder in accordance with the size relationship between the impression cylinder and the blanket cylinders, the first plate cylinder and first blanket cylinder are arranged so as not to transfer indicia although the blanket cylinder is engaged with the impression cylinder, the effective diameter (d) of the first blanket cylinder is made slightly less than the dimension that corresponds to an integral multiple (or reciprocal thereof) of the effective diameter (D) of the impression cylinder, and the pressure between the first blanket cylinder and the impression cylinder is adjusted to be greater than the pressure between the second blanket cylinder and the impression cylinder, the second plate cylinder and blanket cylinder being arranged for one side offset printing, and the offset printing process and the direct planography printing each being controlled in known manner.

When the printing process described is used in a five-cylinder sheet-fed offset press, for perfecting in one color on each side, the first printing unit can be arranged for optimum adjustment to the second and directly planographic printing. Since the second-side printing proceeds in the first printing unit and the first-side printing occurs in the second printing unit, the two printing processes cannot interact. Thus the pressure setting values can be chosen independently for each process. Consequently, the press, which is inherently suitable for two-color first printing, can also be used in optimal conditions for perfecting printing. There is no risk of ink rubbing off one side of the sheet on to a guide or backing cylinder since the printing occurs in a single pass. There are no difficulties with registration since printing proceeds in a gripper closure. This has the further effect of minimizing the tendency of the printing sheet to roll since the sheet must be pulled off an inked printing surface on both sides in a single pass.

The advantage of being able, without complications, to do direct planographic printing and also to use an offset printing press for perfecting too, is often offset by the shorter working life and reduced print quality of the printing plate for direct planographic printing. The process according to the invention, in conjunction with the associated apparatus, enables the press to be adjusted satisfactorily for correct unreeling for both printing processes and for optimum quality of print, more particularly as regards direct planographic printing.

The changeover is a relatively simple matter and requires no additional steps provided that unreeling for planographic printing is such as to be operative after the changeover for two-color first printing alone, having regard to the printing length of both printings. This must be observed between first-side printing and second-side printing. It is important here that the printing length be determined in second-side printing by the direct printing and that the printing length in the first-side printing be adapted correspondingly. The process according to the invention takes account of all these considerations and ensures that both processes can be used with optimum registration, in good print quality, with optimal working life of the printing plate for direct planographic printing and with very little extra cost for perfecting printing. The advantages in operation should be apparent as are the advantages of the relatively reduced expenditure on machinery.

These and other features and advantages of the invention will be more readily apparent upon reading the following description of certain preferred exemplified embodiments of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENTS

Figure 1:
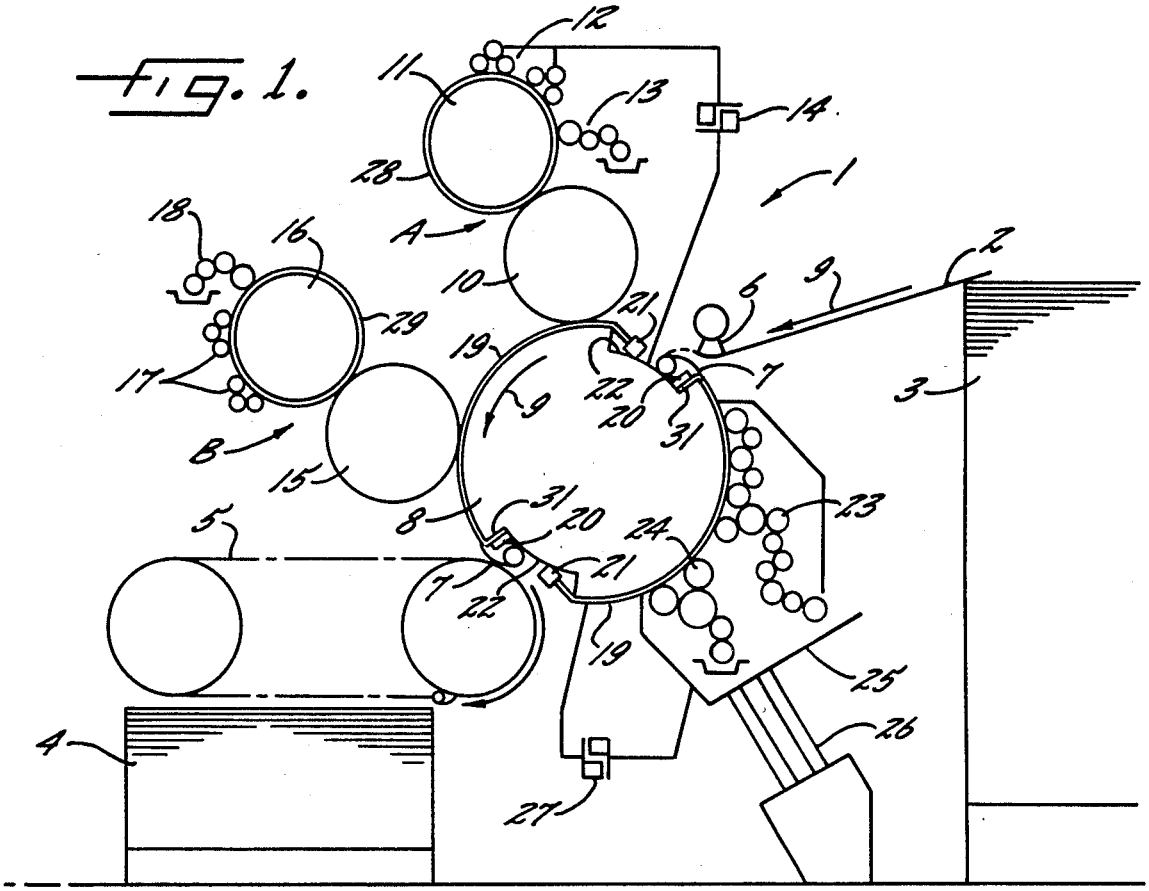
FIG. 1 is a schematic overview of a five-cylinder, sheet-fed printing press of the kind mentioned above and having perfecting printing processes and apparatus according to the invention.

Turning now to the drawings, there is shown in FIG. 1 a sheet-fed offset press 1 having five cylinders. Paper sheets 2 are conveyed from a feed stack 3 through the press 1 to a delivery stack 4 and are deposited thereon by means of a chain conveyor 5. An auxiliary gripper 6 at the entrance of the press 1 is provided for transferring the sheets 2 from the stack 3 to grippers 7 on an impression cylinder 8. In the illustrated embodiment, two rows of grippers 7 are provided on the cylinder 8, with the rows being disposed diametrically opposite one another.

As shown in FIG. 1, the direction of sheet movement is indicated by arrow 9 and it will be seen that a sheet 2 first contacts a first printing unit A, which includes a first blanket cylinder 10 and an associated first plate cylinder 11. An inking device 12 and a damping device 13 are engaged with the plate cylinder 11. The inking device 12 is selectively connected to the machine drive by way of a clutch 14. After passing through the printing zone between the cylinders 8 and 10, the sheet 2 reaches a second printing unit B including a second blanket cylinder 15, a second plate cylinder 16 and, in engagement therewith, an inking device 17 and a damping device 18. After passing through the printing zone between the cylinders 8 and 15, the sheet 2 is transferred to the chain conveyor 5 which delivers the sheet 2 to the delivery stack 4.

In order that the cylinder 8 may also be used for direct planographic printing it has plate holding means adapted to receive planographic printing plates 19. The plate holding means comprise a clamping device 20 and a tensioning device 21. Since, in the illustrated embodiment, the impression cylinder 8 is twice the diameter of the associated blanket cylinders 10, 15 and plate cylinders 11, 16, it has two of the plate holding means 20, 21. It will be understood, of course, that the impression cylinder 8 may have a diameter (D) that corresponds to any integral multiple (or reciprocal thereof) of the nominal diameter (d) of the associated blanket cylinders 10, 15 and plate cylinders 11, 16.

Preferably, the clamping means 20 are disposed at the front end of the printing surface below the grippers 7 in a longitudinal channel 22 of the cylinder 8 and receive the front bent edge 31 of one of the planographic printing plates 19. The rear end of each plate 19 is retained by the tensioning means 21 which are also disposed in the channel 22. The tensioning means 21 hold the plate ends fast and tension them on the impression cylinder 8. A planographic inking device 23 and a damping device 24 are also associated with the impression cylinder 8 to ink and damp the plates 19. The inking and damping devices 23, 24 are preferably mounted in a common unit 25 movable by means of a device 26 radially of the cylinder 8 and engageable therewith. A clutch 27 is selectively actuated to provide a driving engagement between the devices 23, 24 and the machine drive.

In a particularly preferred arrangement, the feed stack 3 is disposed at a sufficient distance from the printing press 1 so that the planographic damping device 24 and inking device 23 are readily accessible for adjustment. The press 1 is also desirably arranged with the two offset printing units A and B disposed above the impression cylinder 8 so that the plate holding means 20, 21 on the cylinder 8 are readily accessible from a walkway (not shown) between the printing units A and B.

In practice, the press 1 may be primarily used for two color first printing. This operation is diagrammatically shown in FIG. 2. For this purpose, offset printing plates 28, 29 are clamped on the plate cylinders 11, 16. It will be understood that when the two offset printing units A and B are adjusted in known manner, and the paper passes through between the blanket cylinders 10, 15 and the impression cylinder 8, a two color print is produced on the top or first side of the paper sheet 2. Care must be taken, of course, to ensure when adjusting pressures not to have too high a pressure between the blanket cylinders 10, 15 and the impression cylinder 8, otherwise the ink transferred by the cylinders 10, 15 may be squeezed out on the sheet 2, with the result of an unwanted widening of the print. When the press is in use as a two color press the planographic inking and damping unit 25 is moved away from the impression cylinder 8 and the clutch 27 is also in the released state so that the bottom inking and damping units 23, 24 are not driven. In the adjustment of the plate cylinders 11, 16 and blanket cylinders 10, 15 care must be taken to ensure that the printing length coincides as between the first printing unit A and the second printing unit B. It is also important for the prints to lie exactly above one another. These adjustments can be attended to by altering the cylinder packings and turning the cylinders relatively to one another in a well-known manner.

Figure 2:
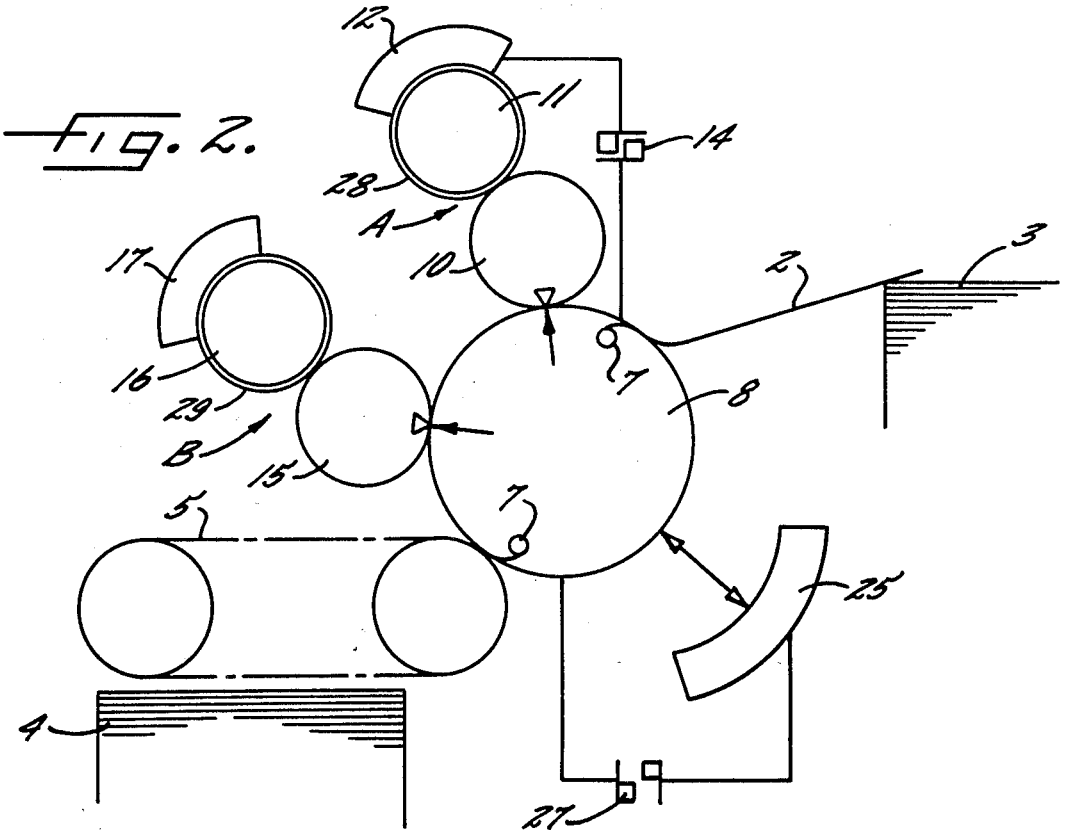
FIG. 2 is a diagrammatic view relating to operation of the press for two color first printing.
Figure 3:
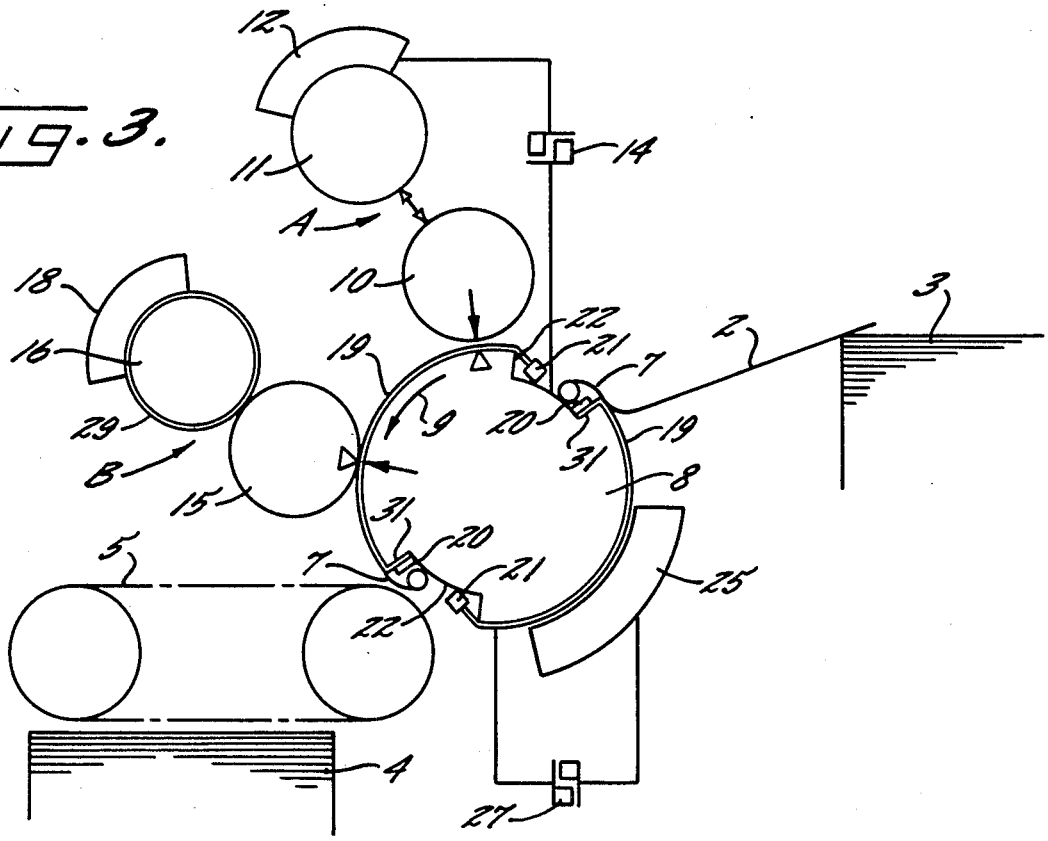
FIG. 3 is a diagrammatic view for perfecting printing with the plate cylinder in the first printing unit inoperative.
Figure 4:
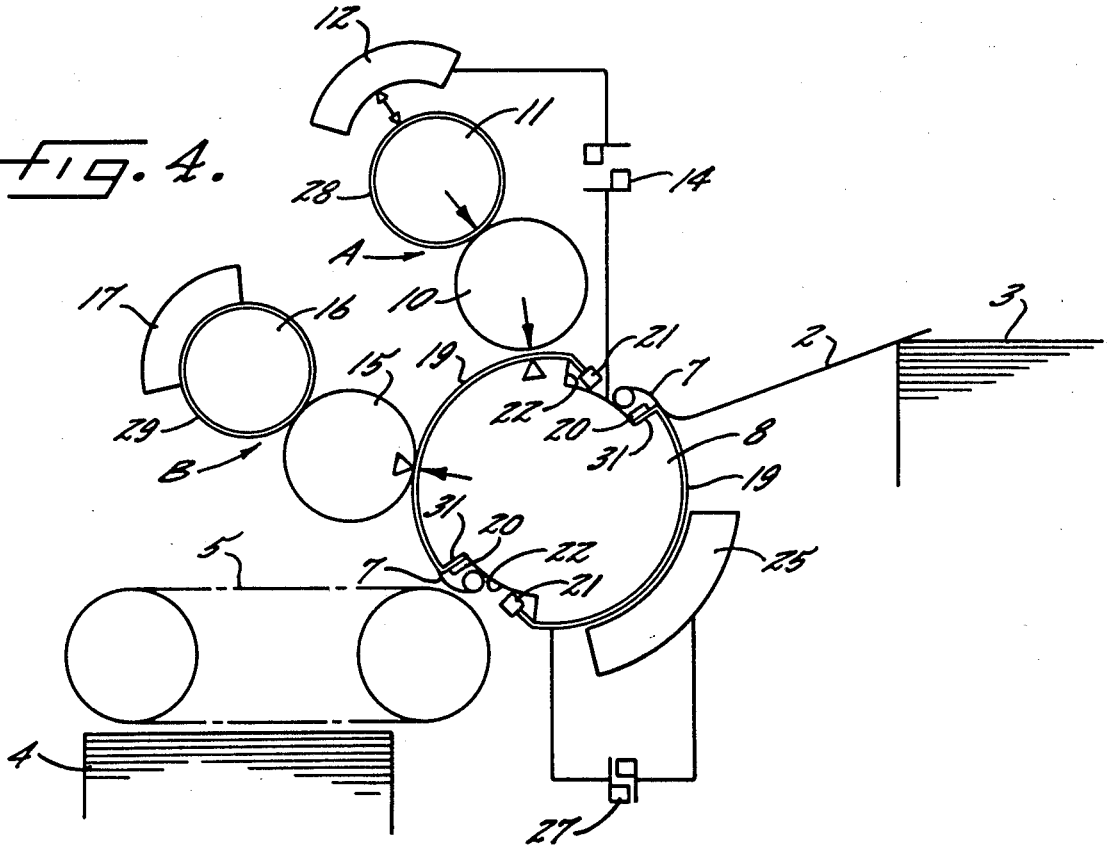
FIG. 4 is a diagrammatic view for perfecting printing with the plate cylinder of the first printing unit operative as a backing cylinder and with the inking device disconnected.

In accordance with the present invention, simple changeover operations can convert the press 1 from the two color offset printing mode shown in FIG. 2 to perfecting printing as shown in FIGS. 3 and 4. As regards the press 1, certain measures must be taken for it to operate as a perfecting press. First, planographic printing plates 19 for direct planography must be clamped to the impression cylinder 8. The plates 19 have at their front edge a bent part 31 serving for clamping on the impression cylinder 8. The bent part 31 is necessary to enable the front end of the plate 19 to be pushed into the clamping means 20 below the grippers 7 on the cylinder 8. Also, each planographic printing plate 19 must have its rear end secured in one of the tensioning means 21 and be drawn down tightly on the surface of the cylinder 8. Advantageously, the cylinder 8 is "raced", in the direction 9 of sheet movement, with the blanket cylinders 10, 15 in engagement with it and with the plates 19 on it. The plates 19 are thereby engaged smoothly on the cylinder 8 and can be stretched or drawn taut without difficulties by the tensioning means 21.

In one embodiment of the invention, the foregoing mode of operation is shown in FIG. 3. An offset plate 29 is clamped to the second plate cylinder 16 for perfecting printing. The plate 29 serves to produce offset printing on one side of the paper. To this end, the second printing unit B is engaged with the impression cylinder 8 in known manner. However, the plate cylinder 11 of the printing first unit A is, together with its associated inking device 12, moved away from the blanket cylinder 10, but the blanket cylinder 10 is still engaged with the impression cylinder 8. Of course, the inking device 23 and the damping device 24 for direct planographic printing must also be moved into engagement with the plates 19 on the impression cylinder 8. The clutch 27 is engaged to provide a driving connection between the press drive and the inking and damping devices 23 and 24 and the press can then be started.

Clearly, for printing to proceed, the blanket cylinders 10, 15 must be engaged with the impression cylinder 8 only when sheets 2 are being conveyed thereby. Without paper, ink would be transferred from the plate 19 to the blanket cylinders 10, 15 and conversely ink would be transferred from the blanket cylinder 15 of the second unit B to the plates 19. During each revolution, the grippers 7 of the cylinder 8 consecutively pick up two sheets of paper. Each sheet 2 lies flat on a plate 19 and is pressed thereonto by the blanket cylinders 10, 15. The cylinder 10 transmits no indicia but the cylinder 15 enables indicia to be printed on the top or first side of the sheet 2. The second side printing indicia is printed directly on the bottom or other side of the sheet 2 by the planographic printing plate 19.

The pressure relationships in the printing zone between the cylinders 8 and 10 are adjusted differently from the pressure relationships in the printing zone between the cylinders 8 and 15. For the second side printing, which proceeds in the first printing zone, the pressure is increased to the extent necessary for high quality direct planographic printing. In other words, conditions for second side printing by the direct planographic printing process are produced deliberately in the printing zone between the impression cylinder 8 and the blanket cylinder 10. After the sheet 2 has passed through the first printing zone, first side printing by the offset method can proceed without restrictions in the second printing zone between the impression cylinder 8 and the blanket cylinder 15 and the pressure in the latter zone can be adapted optimally to offset printing.

It will be understood that the sheet 2 which has passed through the first printing zone tends to stick tightly to the planographic plate 19 and adhesion also occurs during the offset printing between the sheet 2 and the blanket cylinder 15. However, according to the present invention, after passing through the second printing zone, the forces needed to pull the sheet 2 off the inked printing surfaces 15 and 19 tend to reduce one another. In fact, the greater adhesion to the blanket cylinder 15 is reduced by the inherently less adhesion to the plate 19. The break away angle of the sheet 2 on the blanket cylinder 15 is therefore reduced considerably—i.e., the adverse effect of the tendency to roll is reduced considerably as a result of the sheet 2 being pulled off the cylinder 15 by plate 19.

From the foregoing, it will be seen that the complete printing operation proceeds in three stages. The first stage comprises direct planographic printing between the plate 19 and blanket roll 10, the second stage being offset printing between the blanket cylinder 15 and impression cylinder 8 and, in the third and final stage, the sheet 2 is separated from the printing surfaces 15 and 19.

The importance of register for perfecting printing is well known and is particularly significant in the present context. The position of the indicia produced by direct planographic printing relative to the paper is always the same since the sheet 2 is placed directly on the plate 19. However, both the position and the size of the indicia can be varied on the first printing side and these parameters depend upon the cylinder packings and the angular position of the indicia on the blanket cylinder 15 or plate cylinder 16. It is necessary, of course, if the printings on the first side and second side are to be in registration, the start of printing and printing length must agree. The position of the start of printing can be varied in a conventional manner by adjustments in the drive, as is typical in multicolor presses and as must be present in the present press 1 in order to ensure registration between the first and second printing unit A and B. The angular position of the plate cylinders 11 and 16 can be varied, for instance, by an axial movement of helically toothed driving gears. Adaptation of the printing length between the first side printing and second side printing can then be effected by varying the cylinder packings on the blanket cylinder 15 or plate cylinder 16 or impression cylinder 8. However, according to the present invention, only the length of the first side printing by the offset printing method is varied whereas the length of the second side printing by the direct planographic printing process always remains the same, as previously described. It is therefore essential for this kind of perfecting printing that the printing length of a first side printing must be adapted to the printing length of the second side printing, the converse being impossible.

As previously noted, in the perfecting printing process set out here, the plate cylinder 11 of the first printing unit together with its inking device 12 and damping 13 is moved away from the blanket cylinder 10. The plate cylinder 11 therefore rotates idly, as do the devices 12, 13 when they have not been disengaged by the clutch 14. Accordingly, the inking device 12 is desirably provided with a lubricating liquid so damage to the rolls is prevented. In the damping device 13, the rolls are often separated when it is stationary.

In a second embodiment of the invention, and as shown in FIG. 4, the inking device 12 and the damping device 13 of the first printing unit A are moved away from the plate cylinder 11 and disengaged by the clutch 14 from the drive of the press 1. The plate cylinder 11 can now be engaged with the blanket cylinder 10 which, as in the first embodiment and also here, is engaged with the impression cylinder 8.

Conveniently, an old plate or a corresponding packing is left on the plate cylinder 11 and the same is allowed to rotate with and as a backing cylinder to the blanket cylinder 10. No great effects generally occur as regards radial sagging or deflection of the blanket cylinder 10, but this step quiets the running of the printing unit. The inking and damping devices 12, 13 do not rotate in the perfecting printing operation and do not therefore need to be specially equipped and lubricated for dry running. Driving power and expenditure on operation is therefore saved and damage is definitely precluded. The printing under this embodiment proceeds otherwise as in the first embodiment or mode of operation. The cylinder packings are also similarly arranged. Control of the press 1 and the arrangements necessary to initiate printing are simplified since the cylinder 10, 11 of the first printing unit A are cut into operation in conventional manner for printing.

Unreeling between the blanket cylinders 10, 15 and the impression cylinder 8 needs closer consideration and is particularly significant for the direct planographic printing. A criterion for such printing is first that the printing area is reduced by unevenness in the paper surface. This calls for increased pressure to ensure a satisfactory print image. The second important point is that when the blanket cylinder 10 is brought into engagement with the impression cylinder 8, the blanket 30 experiences a deformation leading to flexing during printing. See FIG. 5. Another important consideration is to obviate relative movements in the printing zone between the sheet 2 and the plates 19. These two conditions react on the relationships between the diameters of the blanket cylinder 10 and the impression cylinder 8. For the sake of complete and uniform printing, the blanket cylinder 10 must be engaged with the impression cylinder 8 by at least 0.1 mm more than is normal in offset printing. Indeed, values of up to 0.35 mm are possible. However, at values of this order, the deformation of the blanket 30 and, therefore, the perceptible variation in the diameter of the blanket cylinder 10 in the printing zone becomes very substantial, with the attendant risk of relative movements occurring between the blanket surface and the plate 19. Since in this case, the blanket 30 would entrain the sheet 2, there would be relative movements between the sheet 2 and the plate 19. Paper is known to be somewhat abrasive and would therefore wear the plate 19 very rapidly or even make it unusable after a few printings. This must be avoided in all circumstances.

Consequently, the diameter d of the blanket cylinder 10 must be adjusted to these special conditions in relation to diameter D of the impression cylinder 8. It has been found in tests that reducing the blanket cylinder diameter d relative to the impression cylinder diameter D by from approximately 0.2 to 0.4 mm obviates the risk of relative movement between the sheet 2 and the plate 19.

Figure 5:
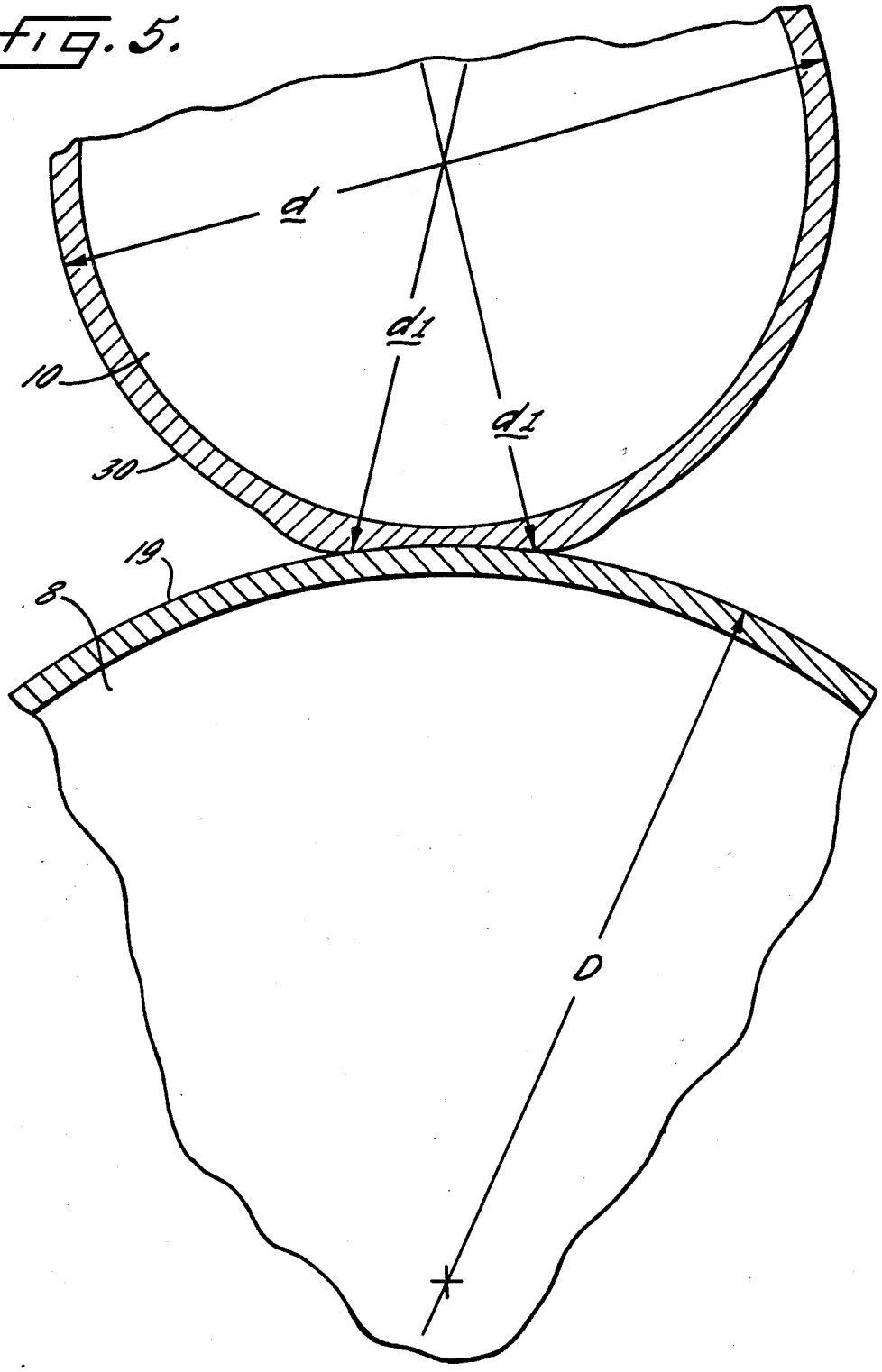
FIG. 5 is an enlarged, fragmentary schematic showing the conditions operative in the printing zone between the impression cylinder and the blanket cylinder when the latter is working as presser.

FIG. 5 diagrammatically illustrates the conditions operative between the blanket cylinder 10 and the impression cylinder 8. The flattening of the blanket 30 in the printing zone is apparent and is illustrated by the designation of the perceptible diameter increases d1 in the blanket beads. This perceptibly greater diameter d1 must be compensated for by a reduction in the actual diameter d of the blanket cylinder, thus ensuring that the contact between the blanket cylinder 10 and the impression cylinder 8 is purely a rolling one not involving any relative movement or slip.

However, the diameter relationships between the blanket cylinder 10 and the impression cylinder 8 must be such as not to entail any alteration of unreeling upon a changeover of the press 1 from two color perfecting. As will be apparent from what has been said about the various modes of operation, this is readily possible since the printing length can be varied by varying the packing of the plate cylinder 11 of the first printing unit A. The diameter of the impression cylinder 8 should therefore be such that the printing lengths produced by the plate cylinders 11, 16 of the top two printing units A and B can be adapted to one another in a simple manner. This means in practice that printing length is corrected mainly by way of the top plate cylinders 11, 16 and less by packing the plates 19 on the impression cylinder 8.

Assuming that in two color offset printing the plates 19 are merely removed from the impression cylinder 8, there would be an alteration in the print image as compared with perfecting printing. Such alteration is allowed for in the first printing unit A by the reduction of blanket cylinder diameter and in the second printing unit B by the reduction of plate cylinder diameter. The plate cylinder diameter. The plate cylinder diameter in the second unit B must be reduced in order to compensate for the variation in print length by the clamping of the plates 19 on the impression cylinder 8 in perfecting printing operation.

Unreeling can be completely simplified if, when the press 1 is changed over, the used plates 19 are left on the impression cylinder 8, in which event the same diameter would be operative for both modes of operation. The press 1 can then be changed over in a simple manner from perfecting printing without special turning facilities or gearing action being needed for the control of the press. Printing proceeds in both modes of operation in a gripper system. Both printing processes aid one another, particularly in the mutual action on the tendency of the papers to roll and therefore do not adversely affect registration.

It should be understood that the process described herein and the press 1 for carrying out the process of the invention are not limited as regards details. It is merely necessary to ensure that the diameter ratios and the pressure adjustment of the cylinders remain constant. The construction of the mechanical elements necessary to accomplish these purposes lies within the scope of the constructional ability of those skilled in the art and therefore needs no further explanation. For instance, in the first mode of perfecting printing, the inking device 12 and damping device 13 can be disconnected by the clutch 14 if they are not required to convey ink and damping agent.

I claim as my invention:

1. A process for perfecting printing on paper sheets wherein the first side of said sheets is printed by the offset method and the second side of said sheets is printed by direct planography by a 5-cylinder, sheet-fed offset press which comprises an impression cylinder; first and second plate cylinders; first and second blanket cylinders, said first and second blanket cylinders being disposed between said impression cylinder and, respectively, said first and second plate cylinders, the diameter (d) of said first blanket cylinder being slightly less than the dimension corresponding to an integral multiple (n) or reciprocal thereof of the effective diameter (D) of the impression cylinder; first, second, and third means for inking and damping, respectively, said first and second plate cylinders and said impression cylinder; means for selectively transferring ink indicia from said plate cylinder to said first blanket cylinder, which indicia transferring means comprise said first plate cylinder and said first inking and damping means; means for selectively activating said indicia transferring means whereby indicia are transferred selectively from said first plate cylinder to said first blanket cylinder; and first and second means for adjusting the pressure between said impression cylinder and, respectively, said first and second blanket cylinder, said process comprising:

(a) affixing at least one direct planography printing plate on said impression cylinder;
(b) disactivating said indicia transferring means whereby no indicia are transferred to said first blanket cylinder;
(c) adjusting the pressure between said first blanket cylinder and said impression cylinder to a pressure suitable for direct planography;
(d) adjusting the pressure between said second blanket cylinder and said impression cylinder to a pressure suitable for offset printing; and
(e) feeding said paper sheets through said press;
(f) printing the second side of said sheets by direct planography in the printing zone between said first blanket cylinder and said impression cylinder; and
(g) offset printing the first side of said sheets in the printing zone between said second blanket cylinder and said impression cylinder.

2. The process of claim 1, wherein said means for selectively activating said indicia transferring means comprises means for selectively engaging said first plate cylinder with said first blanket cylinder and wherein step (b) of said process comprises disengaging said first plate cylinder from said first blanket cylinder, whereby no indicia are transferred from said first plate cylinder to said-first blanket cylinder.

3. The process of claim 2, wherein the diameter (d) of said first blanket cylinder is from about 0.2 to about 0.4 mm less than the effective diameter (D) of said impression cylinder and wherein said process comprises:

(a) affixing a single direct planography printing plate on said impression cylinder;
(b) disengaging said first plate cylinder from said first blanket cylinder, whereby said first blanket cylinder acts as a presser for said impression cylinder and whereby no indicia are transferred from said first plate cylinder to said first blanket cylinder; and (c) adjusting the pressure between said first blanket cylinder and said impression cylinder to a pressure of at least about 0.1 mm greater than the pressure between said second blanket cylinder and said impression cylinder.

4. The process of claim 1, wherein said means for selectively activating said indicia transferring means comprises means for selectively engaging said first inking and damping means with said first plate cylinder and, wherein step (b) of said process comprises disengaging said first inking and damping means from said first plate cylinder, whereby no indicia are transferred from said first plate cylinder to said first blanket cylinder.

5. The process of claim 4, wherein the diameter (d) of said first blanket cylinder is form about 0.2, to about 0.4 mm less than the effective diameter (D) of said impression cylinder and wherein said process comprises:

(a) affixing a single direct planography printing plate on said impression cylinder;

(b) disengaging said first inking and damping means from said first plate cylinder, whereby said first blanket cylinder acts as a presser for said impression cylinder, said first plate cylinder acts as a backing cylinder for said first blanket cylinder, and no indicia are transferred from said first plate cylinder to said first blanket cylinder; and (c) adjusting the pressure between said first blanket cylinder and said impression cylinder to a pressure of at least about 0.1 mm greater than the pressure between said second blanket cylinder and said impression cylinder.

6. A printing press for perfecting printing the first side of paper sheets by the offset method and the second side of paper sheets by direct planography and, selectively, two-color first side, offset printing comprising:

(a) an impression cylinder;

(b) first and second plate cylinders;

(c) a first blanket cylinder disposed between said impression cylinder and said first plate cylinder and having a diameter (d) of slightly less than the dimension corresponding to an integral multiple (n) or reciprocal thereof of the effective diameter (D) of said impression cylinder;

(d) a second blanket cylinder disposed between said impression cylinder and said second plate cylinder;

(e) first and second means for inking and damping, respectively, said first and second plate cylinder;

(f) third means for inking and damping said impression cylinder;

(g) means for selectively transferring ink indicia from said first plate cylinder to said first blanket cylinder, which indicia transferring means comprise said first plate cylinder and said first inking and damning means;

(h) means for selectively activating said indicia transferring means;

(i) means for selectively engaging said third inking and damping means with said impression cylinder; and (j) first and second means for adjusting the pressure between said impression cylinder and, respectively, said first blanket cylinder and said second blanket cylinder.

7. The printing press of claim 6, wherein said means for selectively activating said indicia transferring means comprises means for selectively engaging said first plate cylinder with said first blanket cylinder.

8. The printing press of claim 7, wherein said impression cylinder comprises at lest one row of grippers for conveying paper sheets and means for clamping and tensioning at least one planographic printing plate.

9. The printing press of claim 8, wherein said impression cylinder comprises two rows of gripoers and means for clamping and tensioning two planographic printing plates and said first blanket cylinder has a diameter (d) of slightly less than one half of the effective diameter (D) of said impression cylinder.

10. The printing press of claim 8, wherein said impression cylinder comprises a single row of grippers and means for clamping and tensioning one planographic printing plate on said impression cylinder and said first blanket cylinder has a diameter (d) of from about 0.2 to about 0.4 mm less than the effective diameter (D) of said impression cylinder.

11. The printing press of claim 6, wherein said means for selectively activating said indicia transferring means comprise means for selectively engaging said first inking and damping means with said first plate cylinder.

12. The printing press of claim 11, wherein said impression cylinder comprises at least one row of grippers for conveying paper sheets and means for clamping and tensioning at least ne planographic printing plate.

13. The printing press of claim 12, wherein said impression cylinder comprises two rows of grippers and means for clamping and tensioning two planographic printing plates and said first blanket cylinder has a diameter (d) of slightly less than one half of the effective diameter (D) of said impression cylinder.

14. The printing press of claim 12, wherein said impression cylinder comprises a single row of grippers and means for clamping and tensioning one planographic printing plate on said impression cylinder and said first blanket cylinder has a diameter (d) of from about 0,2 to about 0.4 mm less than the effective diameter (D) of said impression cylinder.

* * * * *